United States Patent [19]

Zucchini

[11] Patent Number: 4,768,964

[45] Date of Patent: Sep. 6, 1988

[54] DEVICE TO FEED SAFETY LOW-VOLTAGE-OPERATED UTILIZATION APPARATUSES WITH ELECTRICITY

[75] Inventor: Guido Zucchini, Brescia, Italy

[73] Assignee: Teknolit S.r.l., Brescia, Italy

[21] Appl. No.: 4,955

[22] Filed: Jan. 20, 1987

[30] Foreign Application Priority Data

Jan. 23, 1986 [IT] Italy ..... 20584/86[U]

[51] Int. Cl.[4] ..... H01R 25/14

[52] U.S. Cl. ..... 439/110; 439/121

[58] Field of Search ..... 439/110, 111, 112, 113, 439/114, 115, 116, 117, 118, 119, 120, 121, 122, 207, 208, 209, 210, 211, 212, 213, 214, 215, 216

[56] References Cited

U.S. PATENT DOCUMENTS 2,310,024 2/1943 Frank et al. ..... 439/121
3,154,646 10/1964 Jurca et al. ..... 439/213
3,214,579 10/1965 Pacini ..... 439/110
3,801,951 4/1974 Kemmerer et al. ..... 439/116
4,279,456 7/1981 Zucchini ..... 439/262

*Primary Examiner*—Gil Weidenfeld
*Assistant Examiner*—Gary F. Paumen
*Attorney, Agent, or Firm*—Laff, Whitesel, Conte & Saret

[57] ABSTRACT

The device comprises a rail (2) inside which two insulating support elements (10) are longitudinally disposed. Said support elements (10) are provided with projecting portions (10*a*) housing respective wires (11) provided with mutually facing contact surfaces (11*a*). The latter slightly project with respect to the projecting portions (10*a*) so that they can come into contact with contact elements (16) extending from a connection shank (13) and substantially flush therewith. The connection shank (13) is part of an adaptor (3) to which a safety low-tension-operated utilization unit can be connected and is engageable with rail (2) through a longitudinal opening (4*a*).

1 Claim, 2 Drawing Sheets

DEVICE TO FEED SAFETY LOW-VOLTAGE-OPERATED UTILIZATION APPARATUSES WITH ELECTRICITY

FIELD AND BACKGROUND OF THE INVENTION

The present invention relates to a device to safely feed electricity to low-voltage utilisation apparatuses and it is particularly used in housing and especially in the field of low-voltage lamps.

It is known that in the field of lighting, the use of low-voltage (12–24 volt) lamps is increasing such lamps make it possible to save a great amount of energy. However the use of these lamps, which are still being developed, involves some difficulties due to the necessity of adapting the same to the ordinary-voltage (220 volt) supply mains. Obviously said solution brings about some drawbacks as the cost of the transformers (one for each lamp) greatly affects the cost of the whole lighting unit. In order to avoid each low-voltagelamp needing to be coupled to a transformer, present manufacturers have tended towards feeding devices which, being connected to the ordinary-voltage supply mains by a single transformer, are capable of feeding a plurality of low-voltage lamps.

To this end electrical lines consisting essentially of a support section member to be applied to a ceiling have already been accomplished, the section members being externally provided, on two opposite faces thereof, with two wires extending over the whole length of the rail. In order to allow the lamps to be connected to the electrical lines, suitable adaptors are provided which are engageable with the lines in a removable manner and which exhibit connecting members adapted to connect the wires of the lines to utilisation units such as lamps and the like.

Although the lines show good qualities as to their practical use and operation, they have however some drawbacks. One of them is due to the fact that wires arranged outside can represent a great danger, should mistakes be made in the electric connections at the moment of setting up the line.

In order to eliminate those drawbacks the availability of electrical lines of the above type in which wires are disposed inside the section member as usually happens when rails used for ordinary-voltage (220 volt) supply mains are concerned, would be desirable.

At this point it is also necessary that the adaptors connecting the electrical lines to the utilisation units do not, for the sake of safety, allow the operating interchangeability between low-voltage adaptors and ordinary-voltage adaptors.

The technical problem to be solved is therefore to provide low-voltage rails structured in such a way that the respective adaptors cannot be wrongly connected to ordinary-voltage rails and vice versa.

OBJECTS

Accordingly, it is an object of the present invention to solve the above specified problem by providing a device to feed low-voltage-operated utilisation apparatuses with electricity which, by the use of electrified rails, is capable of overcoming the above mentioned drawbacks as well as, at the same time, of avoiding the possibility that an ordinary-voltage utilisation unit may be wrongly connected to a low-voltage line and vice versa.

A further object of the present invention is to provide a device to feed low-voltage-operated utilisation apparatuses with electricity which is of easy and cheap construction.

SUMMARY OF THE INVENTION

The foregoing and still further objects will become more apparent from the following. According to the present invention I provide, a device to safely feed electricity to low-voltage-operated utilisation apparatuses, of the type comprising a rail which is engageable with an adaptor in a removable manner, through a connection shank. The adaptor in turn is engageable with a utilisation apparatus. The rail has a pair of insulating support elements disposed longitudinally and housing therein by projecting portions, at least two facing low-voltage wires exhibiting contact surfaces with which contact elements are designed to engage. The contact elements are carried by the connection shank of the adaptor and substantially consisting of laminar bodies extending parallelly to said connection shank and substantially flush therewith.

BRIEF DESCRIPTION OF THE DRAWINGS

Further features and advantages of the invention will become more apparent from the detailed description of a device to feed safety low-tension-operated utilisation apparatuses with electricity, given hereinafter by way of non limiting example with reference to the accompanying drawings in which.

DESCRIPTION OF THE PREFERRED EMBODIMENTS

Figure 1:
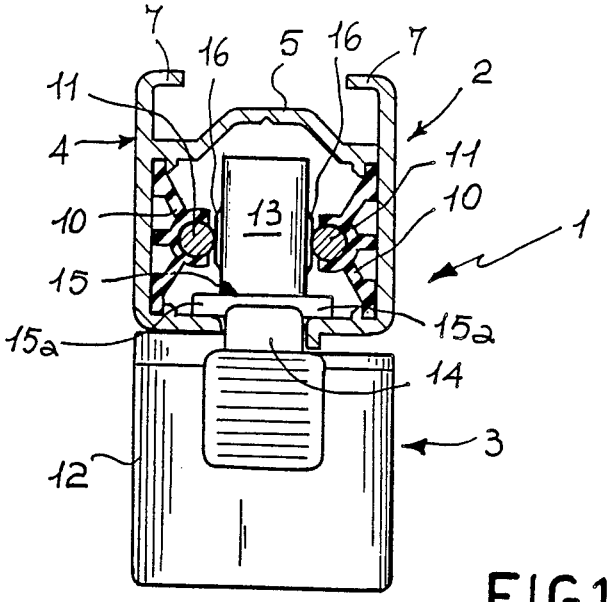
FIG. 1 shows the device to feed safety low-tension-operated utilisation apparatuses with electricity according to the present invention, partly in section.

Referring to said figures and particularly to FIG. 1, reference numeral 1 globally denotes a device to safely feed electricity to low-voltage utilisation apparatuses. Such a device substantially consists of a rail 2 to which an adaptor 3 is connected in a removable manner. Rail 2 (see FIGS. 1 and 2) comprises a section member 4 having a box-shaped section substantially in the form of an inverted U, consisting of a base wall 5 and two substantially parallel side walls 6. The side walls 6 are provided, in the region of the base wall 5, with respective extensions 7. The section of the extensions is in the form of an inverted L so that they may facilitate the fastening of rail 2 to a ceiling or to any other support wall. In the region of their free ends the side walls 6 have facing rims 8, one of which is provided with a locating projection 8*a*, defining a longitudinal opening 4*a* in the section member itself.

In its inner part, section member 4 is provided with restrained fixing lugs 9 designed to come into engagement, in the region of each side wall 6 thereof, with an insulating support element 10. Each support element 10 is disposed longitudinally in rail 2 by means of two projections 10*a*. The projections 10*a* define an engagement housing whose inside accommodates a wire 11.

The wire 11 provides a contact surface 11*a* oriented towards the inner part of the rail.

Advantageously, contact surfaces 11*a* project towards the inner part of the rail and beyond projections 10*a* so that they are directly engaged by two contact elements 16 carried by the adaptor 3, as more clearly seen in the following.

Figure 3:
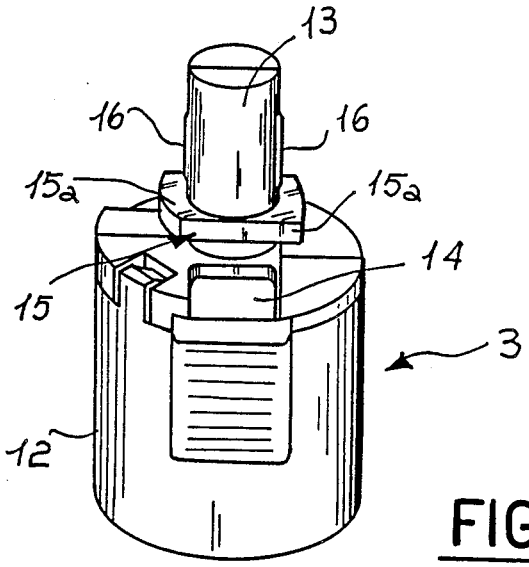
FIG. 3 is a perspective view of an adaptor.
Figure 2:
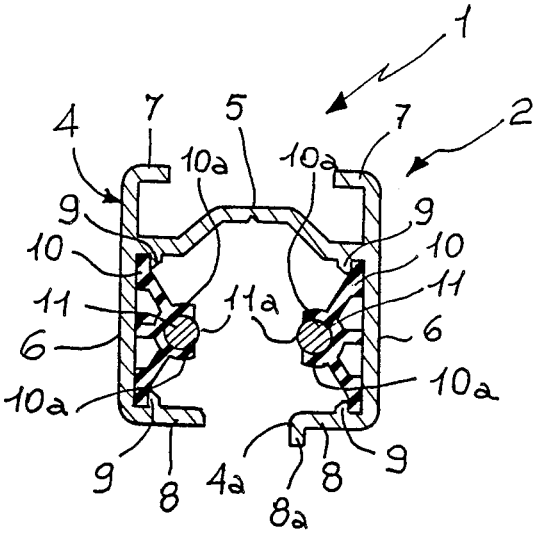
FIG. 2 is a cross-sectional view of a rail being part of the device in question.

Referring particularly to FIGS. 1, 2 and 3, adaptor 3 shown by way of example only essentially consists of a cylindrical body 12 and a connection shank 13, coaxially disposed. A utilisation unit such as a lamp or the like (not shown) may be engaged with the cylindrical body 12 on the side thereof opposite the connection shank 13.

The cylindrical body 12 is also provided with a snap-fastening element 14 disposed on its side facing the lower end of shank 13, which is urged upwardly parallelly to the axis of the cylindrical body 12 by an inner spring not shown.

The connecting shank 13 is provided with a hooking element 15 having a pair of radial wings 15*a*, which is disposed at its end close to the cylindrical body 12. Two radially disposed contact elements 16 lead off from the connection shank 13 through respective apertures; they originally exhibit a laminar conformation extending substantially parallel to the shank 13 itself and substantially flush therewith.

Operation of the device according to the invention described above mainly as regards structure, is as follows.

First of all as previously mentioned, adaptor 3 must be connected to a utilisation unit. For the purpose, after separating the cylindrical body 12 from the shank 13 the electric cables of the lighting unit are introduced into the body 12 and fastened thereto at the inner ends of the contact elements 16. At the end of this operation the shank 13 is fixed onto the cylindrical body 12.

At this point adaptor 3 must be connected to rail 2. For the purpose it is necessary to introduce the shank 13 into the opening 4*a* taking care that the wings 15*a* thereof be oriented in the same direction as the opening 4*a* itself. Afterwards, adaptor 3 is rotated through 90° so that its contact elements 16 get into engagement with the contact surfaces of wires 11 carried by rail 2.

Figure 4:
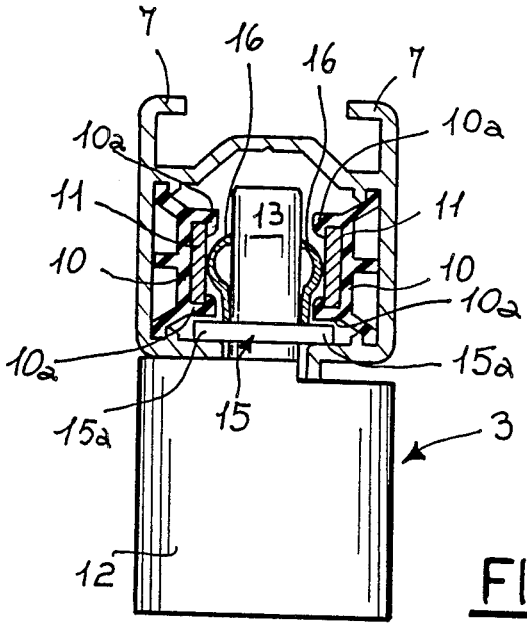
FIG. 4 is a diagrammatic view of an alternative embodiment of the present invention.

In FIG. 4 an alternative embodiment of the device according to the invention is shown. This solution differs from the one previously described due to the conformation of wires 11', which are in the form of a strap, and of the respective insulating support elements 10'. In this case the projecting portions 10*a'* of the insulating support elements 10' have a hook-shaped conformation so that they may fixedly surround the strap-shaped wires 11'. Thus, the contact elements 16' are shaped in such a way that they project towards the respective contact surfaces 11*a'*, so that they can easily engage with wires 11'.

The invention attains the intended purposes. In fact, the original arrangement of wires 11 as described above allows the opening 4*a* in rail 2 to be maintained within very reduced sizes so that the introduction of any ordinary-tension adaptor of known type into rail 2 is not possible. Furthermore, the above mentioned arrangement of the wires involves the use of adaptors 3 the contact elements 16 of which extend substantially parallel to the corresponding shank 13 and flush therewith. This particular character makes it impossible to connect, either electrically or mechanically, low-voltage adaptors 3 to currently known ordinary-voltage rails.

It is important to note that the combination between the described arrangement of wires 11 and the conformation of contact elements 16 enables the production of adaptors 3 that can be connected to rail 2 by merely snap-fitting the shank 13 into the opening 4*a*, differently from the methods hitherto used in which, in addition to the above operation, it is necessary to actuate levers or carry out rotations in order to achieve the same purpose. In fact, both the position and arrangement of contacts 16 provided in adaptor 3 allow said contacts to fit onto the low-voltage wires 11 directly by using their elasticity.

Obviously modifications and variations may be made to the device in question, all falling within the scope of the inventive idea.

What is claimed is:

1. A device to safely feed low-voltage utilization apparatus with electricity, said device comprising a rail; an adaptor engageable in a removable manner in said rail and having a connection shank provided with contact elements consisting of laminar bodies extending parallel to the connection shank and substantially flush therewith; a pair of insulating support elements disposed longitudinally in the rail and having projecting portions; and at least two facing low-voltage wires housed in the insulating support elements between the projecting portions and exhibiting contact surfaces engageable with the contact elements of the connection shank and projecting inwardly in the rail beyond the projecting portions of the insulating support elements.

* * * * *